US006290423B1

(12) United States Patent
Jungkind

(10) Patent No.: US 6,290,423 B1
(45) Date of Patent: Sep. 18, 2001

(54) SELECTIVELY CLOSABLE AND RELEASABLE CONNECTING DEVICE

(75) Inventor: Roland Jungkind, Garmisch-Partenkirchen (DE)

(73) Assignee: MS Trade Handels GmbH (DE)

( * ) Notice: Subject to any disclaimer, the term of this patent is extended or adjusted under 35 U.S.C. 154(b) by 0 days.

(21) Appl. No.: 09/197,635

(22) Filed: Nov. 23, 1998

(30) Foreign Application Priority Data

Dec. 5, 1997 (DE) ..... 197 54 041

(51) Int. Cl.[7] ..... F16B 2/18; A63C 9/00

(52) U.S. Cl. ..... 403/322.1; 403/350; 280/14.2; 280/607; 280/613

(58) Field of Search ..... 403/322.1, 322.4, 403/348, 350, 374.5; 280/613, 623, 625, DIG. 12, DIG. 13, 607, 14.2

(56) References Cited

U.S. PATENT DOCUMENTS

| | | | | |
|---|---|---|---|---|
| 5,044,654 | * | 9/1991 | Meyer | 280/613 |
| 5,586,779 | * | 12/1996 | Dawes et al. | 280/613 X |
| 5,906,388 | * | 5/1999 | Neiley | 280/613 |
| 5,913,530 | * | 6/1999 | Berger et al. | 280/613 X |
| 5,941,555 | * | 8/1999 | Dodge | 280/623 |
| 5,947,488 | * | 9/1999 | Gorza et al. | 280/14.2 |
| 6,065,767 | * | 5/2000 | Girotto et al. | 280/607 |
| 6,065,768 | * | 5/2000 | Lee | 280/613 |
| 6,164,682 | * | 12/2000 | Okajima et al. | 280/613 |

FOREIGN PATENT DOCUMENTS

| | | |
|---|---|---|
| 196 11 111 | 9/1997 | (DE) . |
| 0 788 819 | 8/1997 | (EP) . |
| 2 725 140 | 4/1996 | (FR) . |
| TV960108 | 12/1996 | (IT) . |
| 98 09690 | 3/1998 | (WO) . |

* cited by examiner

*Primary Examiner*—Harry C. Kim
(74) *Attorney, Agent, or Firm*—Schnader Harrison Segal & Lewis LLP

(57) ABSTRACT

A selectively closable and releasable connecting device for connecting a sports shoe and an item of sports equipment, has a baseplate for fixedly mounting to the item of sports equipment and on which the shoe sole can be supported and locked. The shoe being provided with lateral grooves for receiving a pair of locking elements of the connecting device, which lie rigidly and fixedly diametrically opposite each other on the baseplate with respect to a central pivot for the shoe. The device has a second pair of locking elements which likewise lie diametrically opposite one another and are rotatably connected to the baseplate via a gear mechanism having a driving element with a driver which protrudes, with respect to the supporting surface of the baseplate, for activation by the shoe, in the baseplate. The baseplate is further provided with a gear mechanism locking element which locks the gear mechanism in the closed position. The second pair of locking elements selectively rotate, along with the gear mechanism between a shoe-engaging locked position to an unlocked entry/exit position.

18 Claims, 8 Drawing Sheets

SELECTIVELY CLOSABLE AND RELEASABLE CONNECTING DEVICE

FIELD OF THE INVENTION

The invention relates to a selectively closable and releasable connecting device for connecting a sports shoe and an item of sports equipment, preferably a snowboard, having a baseplate which can be mounted fixedly on said item of sports equipment and on which the shoe sole can be supported and locked, the latter being provided, for this purpose, with lateral grooves for receiving locking elements of the device, two of which are provided rigidly on the baseplate lying diametrically opposite each other, with respect to a central pivot for the shoe.

DESCRIPTION OF THE RELATED ART

A multiplicity of connecting devices for snowboards and snowboard shoes are known either from practice or from the prior art on paper. For example, reference may be made to DE 94 13 356 U1.

The connecting devices proposed here have at least two holding elements for the shoe, which elements engage on the longitudinal sides of the shoe sole, and at least one fastening means which can be actuated counter to spring force and has an actuating part on which the shoe, when introduced into the device, acts counter to the spring force and in so doing brings the fastening means from an open position into a holding position.

In comparison with other known connecting devices for connecting a snowboard shoe and a snowboard, the above-mentioned connecting devices have to be able to be of short design, with respect to their longitudinal extent, so that sharply truncated swings can be executed without any problem even with extremely narrow snowboards. Furthermore, manual closing of the connecting device after the shoe has been introduced is avoided.

In addition to various designs of connecting devices having a "step in" option, i.e. the transfer of the corresponding fastening means from its opening into its holding position by pressing the rear end of the shoe down onto the baseplate, a connecting device design is also shown in which the shoe is positioned on the baseplate obliquely with respect to the position of use and can be brought into its holding position by subsequent pivoting about a vertical axis.

As the shoe sole is lowered, it presses an actuating part, which protrudes with respect to the baseplate, down counter to the spring force and releases it at the end of the pivoting movement. The actuating part is pushed up again by the spring force and is then used as a fastening means. Two fixed cheeks, which lie diametrically opposite each other, with respect to the pivoting axis, are provided on the baseplate as further fastening means.

Like other known constructions having only two lateral locking elements which secure the shoe against lifting off from and being displaced on the baseplate, this construction has the disadvantage of an inadequate connection between the board and shoe, which does not permit the board to be precisely guided, in particular in extreme situations and on steep terrain, which makes the user uncertain and also puts him at risk.

In comparison with the "twist in" principle, the "step in" principle for closing the connecting device has the substantial disadvantage of the device having largely to be free of snow and ice before a shoe is introduced so that the necessary locking can take place.

SUMMARY OF THE INVENTION

Starting from the known, abovedescribed twist-in binding, the invention aims to provide a connecting device which optimally secures the shoe, in the position of use, on the item of sports equipment, with the result that the latter can readily be controlled and precisely steered by the user in all situations.

Starting from a connecting device of the generic type, this aim is achieved according to the invention in that the device has a further locking element for each side of the shoe sole, in that these further locking elements likewise lie diametrically opposite one another and are connected to the baseplate via a gear mechanism, in that as driving element of the gear mechanism there is provided at least one driver which protrudes with respect to the supporting surface of the baseplate, can be actuated by the shoe and is guided in an elongated hole, which is curved about the central pivot, in the baseplate, and in that the baseplate has, for the gear mechanism, a locking element which blocks the gear mechanism in the closed position. This construction thus provides a twist-in binding which in each case has two locking elements for both longitudinal sides of the shoe sole.

In order to design the connecting device such that it is as compact and lightweight as possible, the baseplate is expediently designed as a housing for the gear mechanism.

In a design refinement of the invention, the gear mechanism can have a toothed ring which can be pivoted about the central pivot and bears the two movable locking elements. As driver use can then be made of the spindle of a toothed wheel whose teeth mesh, on the one hand, with those of the toothed ring and, on the other hand, with an internal toothing fixed on the baseplate.

The spindle of the toothed wheel expediently tapers at its free end. In this case, it is then provided for direct engagement into a hole in the shoe sole. At its semicircle which is directed towards the ski tip, this hole can merge into a widening clearance in the shoe sole thereby enabling easy positioning of the shoe when it is placed onto the baseplate.

It is possible to avoid clearances in the tread of the shoe sole if the spindle of the toothed wheel bears a U-shaped step-on hoop, the spacing of the limbs of which corresponds to the width of the sole.

In place of a toothed ring in the gear mechanism, other constructions of the connecting device according to the invention provide a disc which can be rotated about the central pivot and on which the driver is provided. In a first design, the driver is in operative connection with one arm of a two-armed lever which is mounted pivotably about a vertical spindle in the baseplate. In this case, a ram is in each case coupled to the free ends of the two lever arms, and slideways for the rams are provided in the baseplate. The free ends of the rams form or bear the further locking elements according to the invention.

Another design envisages that the further locking elements are designed as rotary locks, are mounted on vertical spindles in the baseplate and are loaded in the opening direction by a spring, that on the outside the rotary locks bear a control curve which is acted upon by a roller, and that these rollers are mounted on spindles which are arranged parallel to the driver on the rotatable disc.

In this case, the rotary lock can be provided with an opening lug in place of the spring, or else additionally thereto, the control curve then extending to the end of the lug.

In all of the constructions mentioned two drivers are expediently provided, to be precise, such that the two lie in the vertical longitudinal central plane of the device, in the closed position of the device. This not only removes the risk of an element of the gear mechanism possibly jamming, but also gives a better actuating option by the shoe which, in the case of pins being directly used as drivers, then also has a second hole in the shoe sole.

A further construction of the connecting device according to the invention having two drivers envisages that each driver is in operative connection with a slide, that the slides are of identical design and are mounted in slideways of the baseplate, and that the free ends of the slides form or bear the further locking elements.

As locking element for blocking the gear mechanism in the closed position provision is made for a locking pin which can be displaced vertically in the baseplate, is loaded by a spring and can be latched, by its inner end, into a latching recess in the toothed ring or the disc of the gear mechanism. At its outer end, the locking pin is designed as an actuating handle or for the connection of such a handle.

It is likewise possible, as locking element for the gear mechanism, for use to be made of a spring-loaded locking pawl on the baseplate, for a locking tooth to be provided on the toothed ring or the disc of the gear mechanism, and for the locking pawl to have an actuating handle or the connection for such a handle.

A further construction envisages that, as locking element for the gear mechanism provision is made for a double lever, in the manner of a beer-bottle fastener, between the baseplate and the toothed ring or the disc.

BRIEF DESCRIPTION OF THE DRAWINGS

In the following, exemplary embodiments of the subject matter of the invention are described with reference to the attached drawings which show the following.

DETAILED DESCRIPTION

Figure 1:
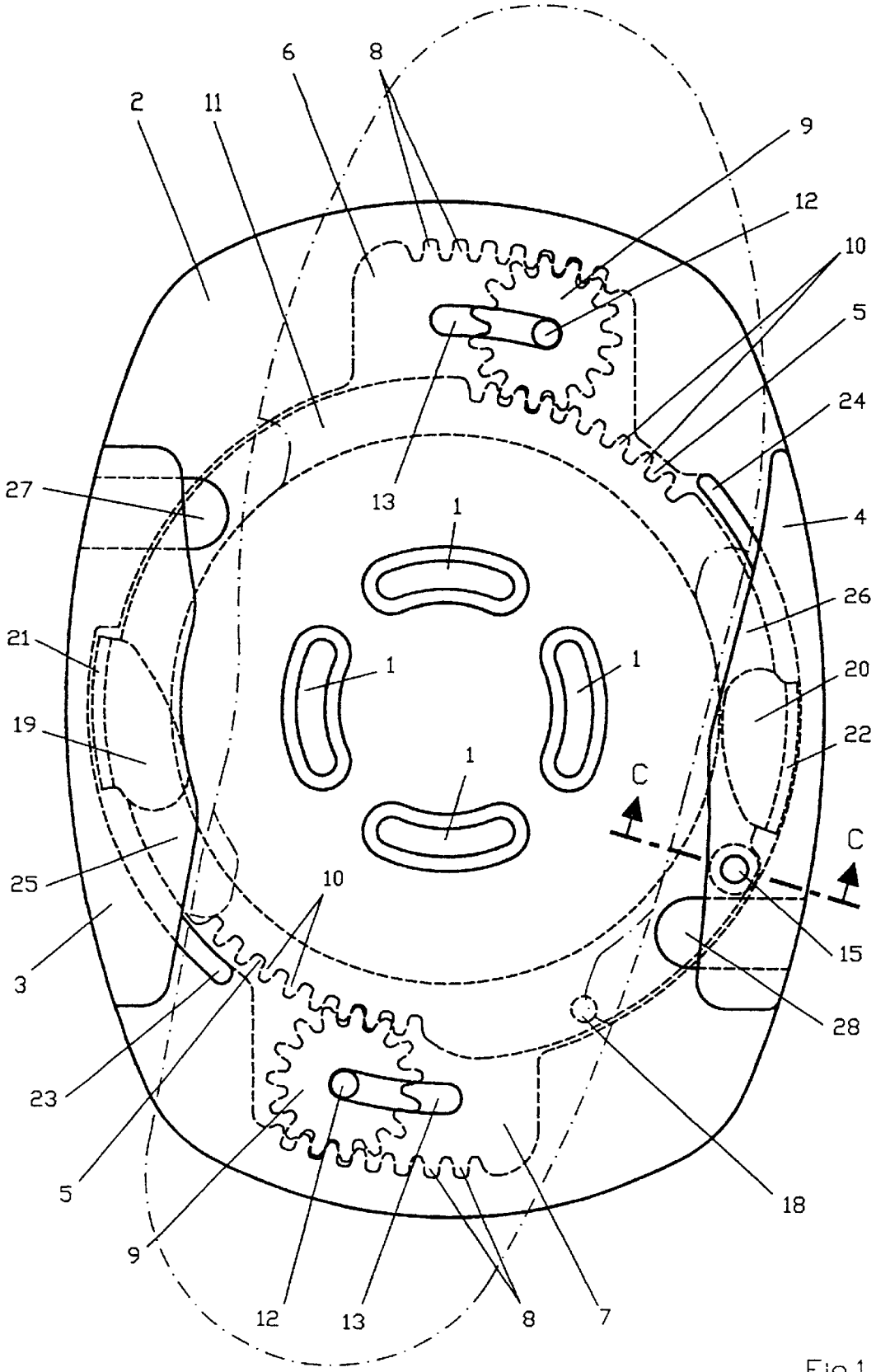
FIG. 1: the plan view of the connecting device in the opened condition.

The connecting devices which are shown are used for connecting a snowboard shoe to a snowboard. The snowboard shoe or its sole is indicated by dash-dotted lines in most of the figures, whereas an illustration of the snowboard has been left out. In all of the designs shown, the respective baseplate has, in its central region, four elongated holes 1 which are curved about the centre and serve in a known manner for receiving fastening screws. The snowboard shoes which are used have a fixed sole with clearances incorporated therein, as is already basically known.

The essential feature for the invention is that the connecting device has two locking elements for each side of the shoe sole, which elements lie in pairs diametrically opposite one another.

The design according to FIGS. 1 to 5 provides a baseplate 2 which in each case bears a wall 3 or 4 in the central region of its two longitudinal sides. The insides of the walls are designed and spaced apart from one another in such a manner that the shoe can be inserted, by means of its sole, between them and can be pivoted to a sufficient extent. An annular groove 5 of the baseplate is widened at the front and rear, at 6 and 7, respectively, and in this region, on the inside, is provided with an internal toothing 8. Two toothed wheels 9, which are in the manner of planet wheels, are in engagement with these toothings and, on the other hand, are in engagement with teeth 10 which are provided on a toothed ring 11 which is mounted in the annular groove 5 of the baseplate. The toothed wheels 9 are mounted, via their spindles 12, in elongated holes 13, curved about the central pivot, of the baseplate 2.

Figure 2:
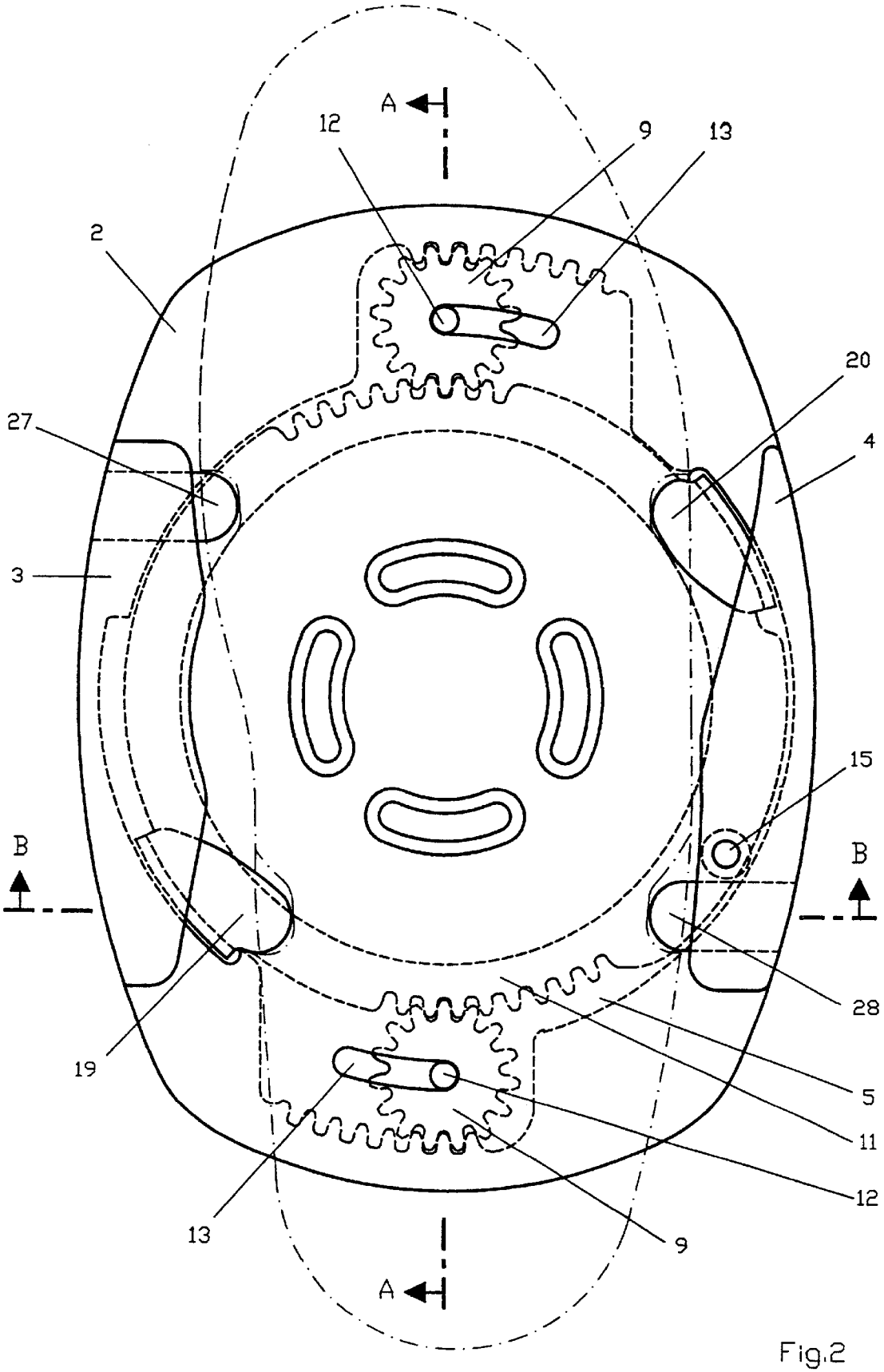
FIG. 2: the plan view corresponding to FIG. 1, but in the closed condition of the connecting device.
Figure 3:
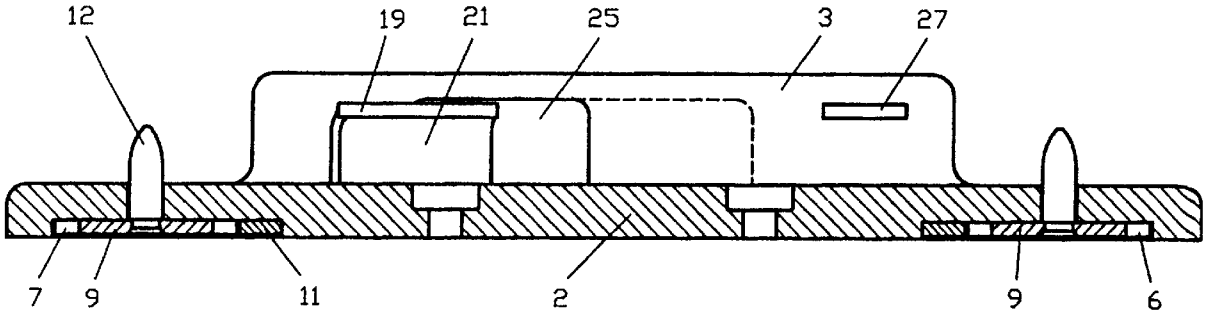
FIG. 3: a longitudinal section through the connecting device according to the line A—A in FIG. 2, FIG. 4: a cross section through the connecting device according to the line B—B in FIG. 2, FIG. 5: a subsection according to the line C—C in FIG. 1, FIG. 6: the plan view of a second design of the connecting device, again in the opened condition.
Figure 11:
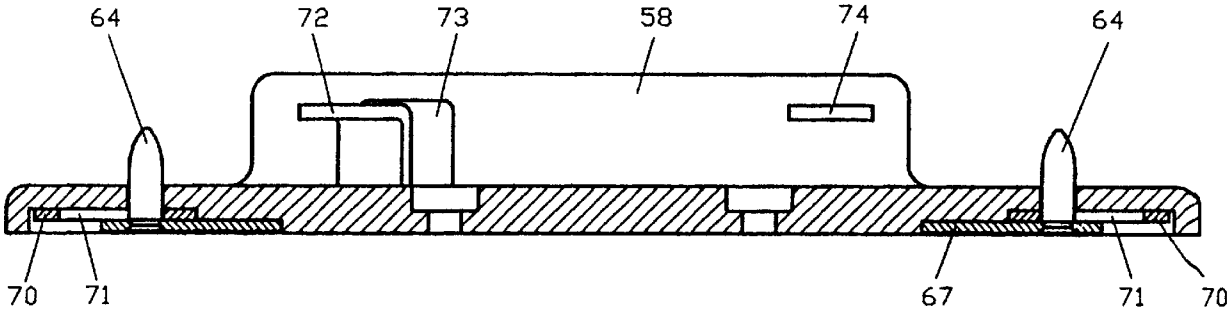
FIG. 11: a longitudinal section through the connecting device according to the line E—E in FIG. 10, and FIG. 12: a side view of the connecting device in the arrow direction F in FIG. 9.
Figure 12:
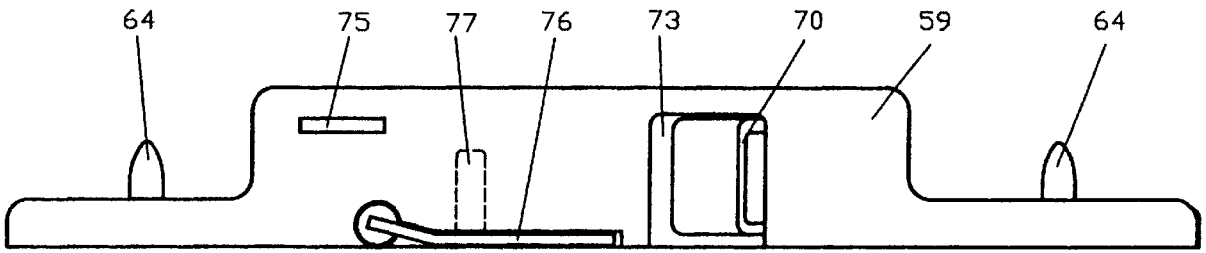
Figure 4:
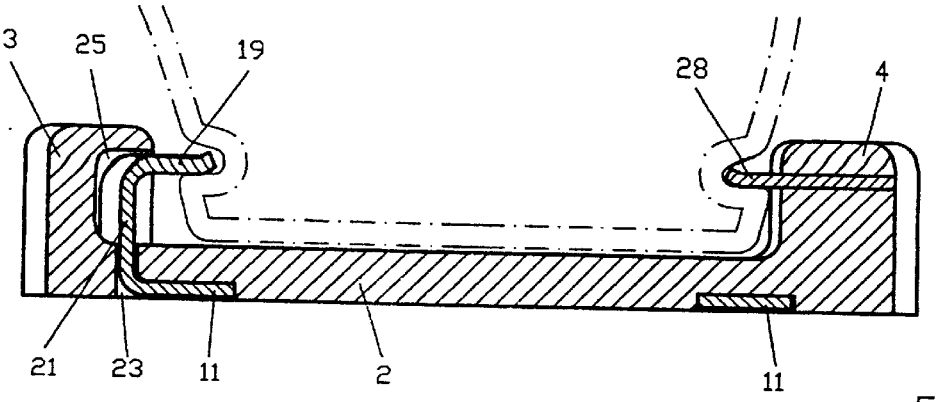
Figure 5:
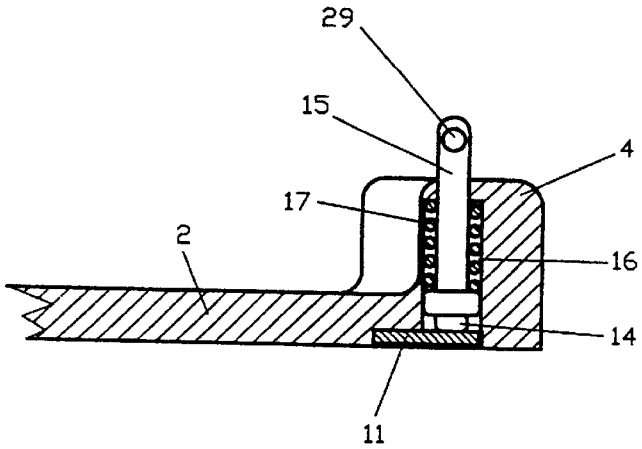

As can be seen in FIG. 3, the spindles 12 of the toothed wheel extend upwards out of the baseplate 2 and taper at their free ends. With these free ends the spindles form the drivers which can engage into corresponding holes in the shoe sole and are used as driving element of the gear mechanism, for closing or releasing the connecting device. In the closed position of the connecting device the two drivers lie in the vertical longitudinal central plane (cf. FIG. 2).

To secure the closing position of the connecting device there is provided a locking element which is formed by the lower end 14 of a pin 15 which is provided in a vertical recess 16 in the wall 4 of the baseplate 2 and by means of its upper end protrudes out of the wall. The pin is loaded downwards by means of a spring 17, with the result that in the locking position unintentional release of the connecting device is not possible. A hole 18 in the toothed ring 11, which hole is used for the engagement of the lower end 14 of the pin, can be seen in FIG. 1.

The toothed ring 11 bears two locking elements 19, 20. These elements are of integral design with the toothed ring and reach through the end of a respective double bend 21 or 22, respectively. These bends extend through slots 23, 24 in the baseplate 2, which slots open into sufficiently large recesses 25, 26 in the walls 3 and 4 (cf. FIG. 4 in particular). Finally, each side wall 3 or 4 furthermore bears a locking element 27 or 28, respectively. These locking elements, which are mounted immovably in the walls, lie diametrically opposite to one another, with respect to the central pivot for the shoe.

FIG. 1 shows the connecting device in the entry and exit position. In this position, the shoe can simply be raised from the baseplate. When entering into the connecting device, the shoe can be lowered into the position on the baseplate which is shown by dash-dotted lines. In this case, the free ends of the spindles 12, which are used as drivers, enter into the correspondingly provided holes in the shoe sole. It is expedient if at least the front hole is widened towards the shoe tip so that when the shoe is introduced, its positioning results automatically with a movement forwards. As is known from other types of connecting devices, the shoe sole has two grooves on each side for receiving the locking elements.

When the shoe is pivoted on the baseplate 2 from the position according to FIG. 1 into that according to FIG. 2, the toothed wheels 9 are driven via their spindles 12. Owing to the meshing with the internal toothings 8 of the baseplate, a correspondingly larger pivoting angle for the toothed ring 11 results. With the pivoting of the shoe, the fixed locking elements 27, 28 enter into the provided grooves in the shoe sole. At the same time, a relative movement of the toothed ring 11 with respect to the shoe sole by means of the locking elements 19 and 20 takes place in such a manner that at the end of the movement, these locking elements likewise enter into the corresponding, lateral grooves of the shoe sole. Furthermore, directly at the end of the pivoting movement the lower end 14 of the pin 15 latches into the hole 18 in the toothed ring. The latter is thereby blocked in the baseplate and thus the shoe is also fastened on the baseplate. The locking element secures a shoe on the baseplate both against rotation and against lifting off. Additional securing against rotation is furthermore provided by the spindles 12.

To release the shoe it is merely necessary to unlock the pin 15, by overcoming the force of the spring 17, and therefore to release the toothed ring 11. The pin can expediently be pulled using a special handle, for example a catch strap. For connection of the latter, a hole 29 is provided at the free end of the pin. By pivoting the shoe from the position according to FIG. 2 into the position according to FIG. 1 the grooves in the shoe sole finally come free from the locking elements. The shoe can then simply be lifted from the baseplate 2.

Figure 8:
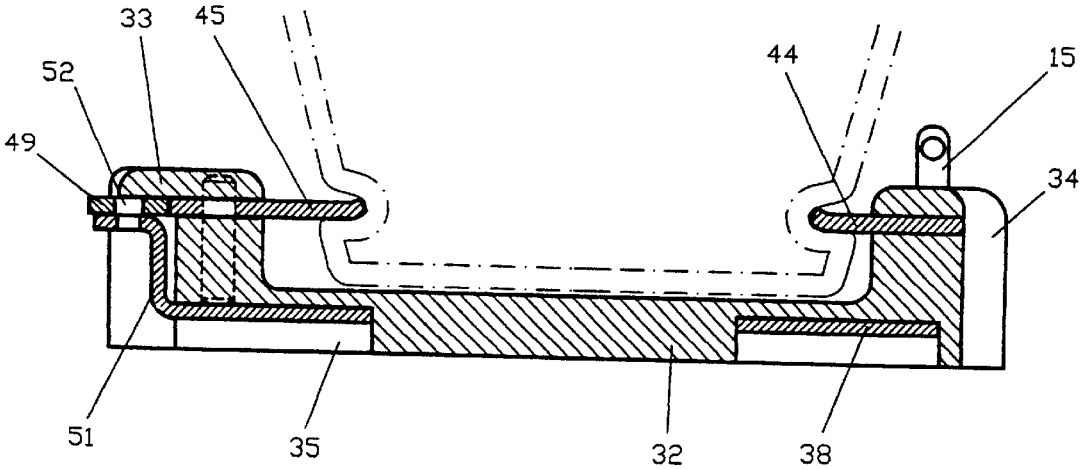
FIG. 8: a cross section through the connecting device according to the line D—D in FIG. 7, FIG. 9: the plan view of a third design of the connecting device in the opened condition.
Figure 6:
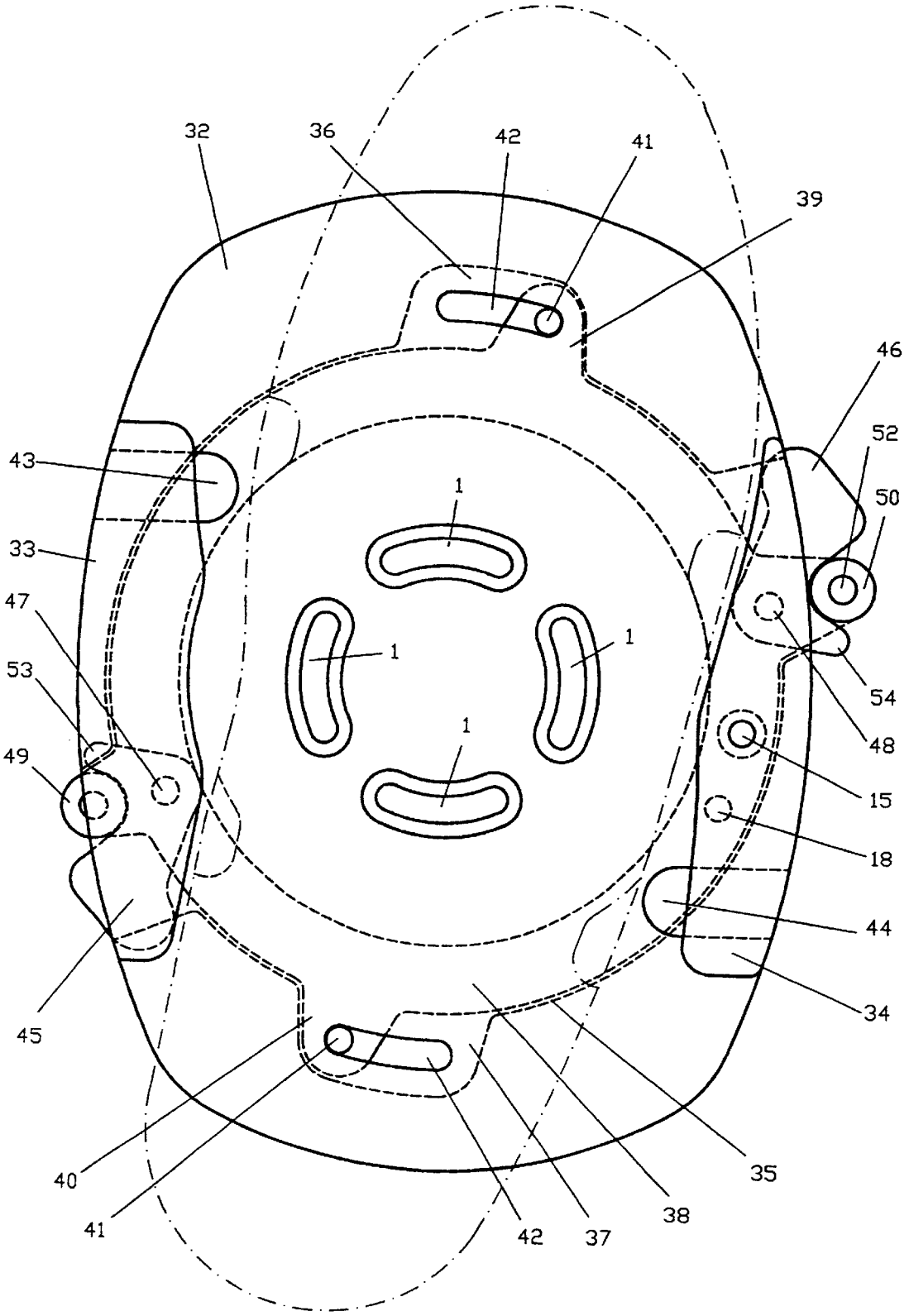
Figure 7:
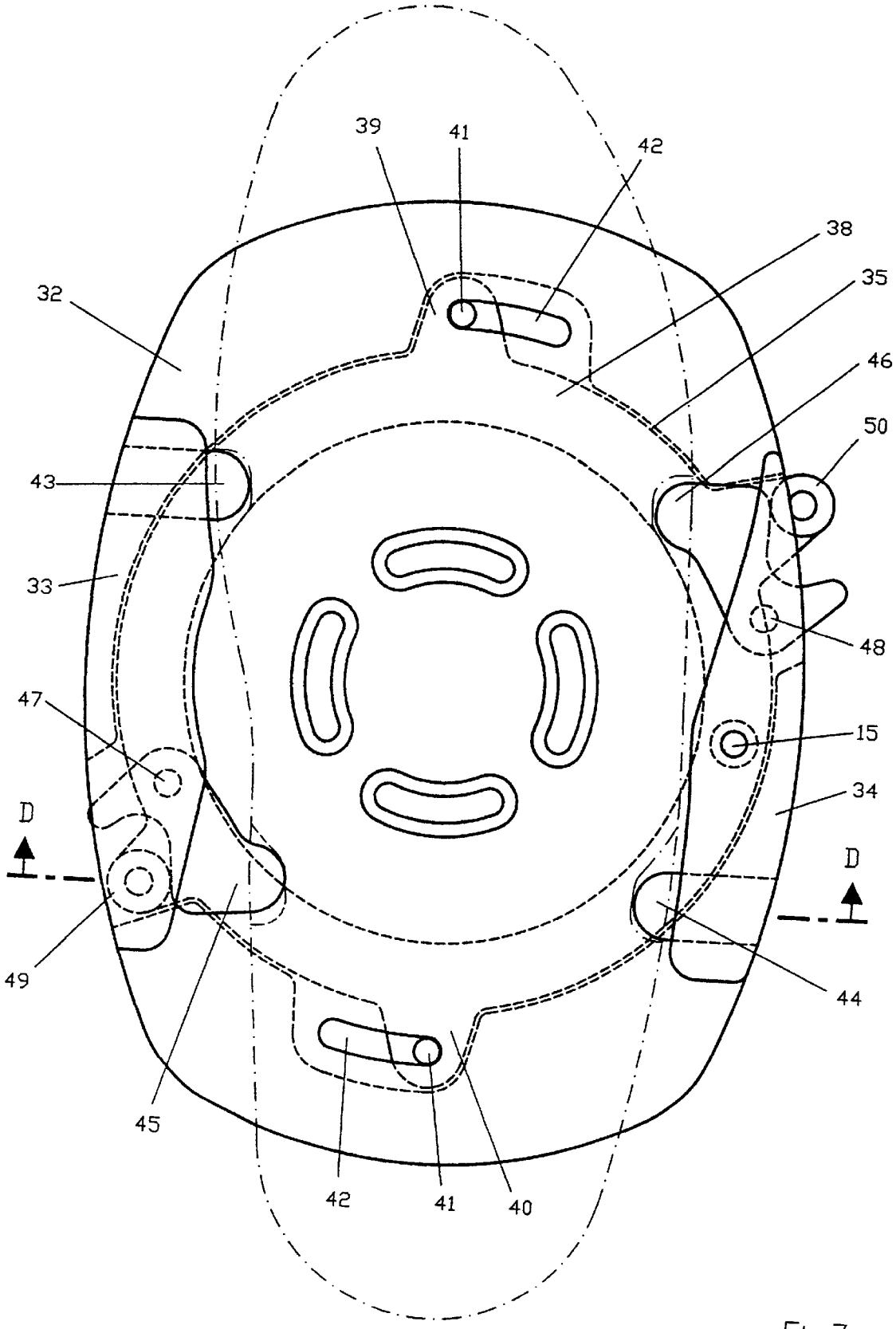
FIG. 7: a plan view corresponding to FIG. 6, but in the closed condition of the connecting device.

In the design according to FIGS. 6 to 8, a baseplate 32 is again provided, which baseplate bears lateral walls 33 and 34. There is likewise also an annular recess 35 which has a front widened portion 36 and a rear widened portion 37. In this case, the recess has mounted in it an annular disc 38 which engages, by means of projections 39, 40, into the widened portions. These projections each bear a pin 41 which extends upwards at right angles. As in the case of the first exemplary embodiment, the pins extend through elongated holes 42, curved about a central pivot, in the baseplate 32. As in the first design, a fixedly arranged locking element 43, 44 is provided in each wall 33, 34. However, in the present case, a further locking element is in each case formed in each side wall as a rotary lock 45 or 46, which rotary locks can be pivoted about a spindle 47 or 48 in their respective side wall. The outer end side of each rotary lock is designed as a control curve along which a respective roller 49 or 50 can roll. The disc 38 is provided with two further projections 51 which, as can be seen in FIG. 8, are bent in a Z-shape and in each case bear a roller 49 or 50 by means of a spindle 52. In the present case, loading the rotary locks in the opening direction by means of springs is omitted. For this purpose, the rotary locks are designed as angle levers whose short lever arm forms an opening lug 53 or 54. In this case, the control curve extends to the end of the lug.

The locking device for securing the disc 38 against rotation, and hence for fixing the gear mechanism in the closed position of the connecting device, corresponds to the device of the design described with reference to FIGS. 1 to 5 and to which reference is hereby made.

The functioning of this connecting device corresponds in principle to the connecting device according to FIGS. 1 to 5. FIG. 6 shows the entry and exit positions. The shoe sole, which is shown by dash-dotted lines, shows that it is free of all locking position according to FIG. 6 into the position according to FIG. 7, the disc 38 is pivoted via the pins 41 and the rotary locks 45, 46 are likewise pivoted by the rollers 49, 50, to be precise about their spindles 47, 48. At the end of the movement all of the locking elements engage into the corresponding grooves of the shoe sole. Likewise, at the end of the pivoting movement the pin 15 also latches into the hole 18 in the disc 38.

To release the shoe it is, in turn, only necessary to pull the pin 15 out of the hole 18 and to pivot the shoe again into the position according to FIG. 6.

FIGS. 9 to 12 show a third exemplary embodiment of a connecting device according to the invention. The baseplate, which is denoted by 57, again bears lateral walls 58, 59. An annular groove 60 is provided in the baseplate, which groove has a front widened portion 61 and a rear widened portion 62, as in the preceding designs. Likewise as in the previously described designs, the baseplate is again provided with elongated holes 63 which are curved about a central pivot and through which pins 64, serving as drivers, extend. These drivers are situated on projections 65, 66 of an annular disc 67 which is mounted in the annular groove 60 of the baseplate. Above the disc two slideways 68, 69 are provided in the baseplate to receive in each case one of two identical slides 70. These slides 70 are bent at their inner ends and in these bends have an elongated hole 71 whose width corresponds to the diameter of the pins 64 and through which in each case one of the pins passes (cf. FIG. 11, in particular). The outer end of the slide, formed from flat material, is bent and bent back again (cf. FIG. 12, in particular). By means of these bent-back parts, denoted by 72, the two slides each form a locking element. To receive this end of the slides, the slideways 68, 69 in the baseplate open into in each case one appropriately sized recess 73 in the side walls 58, 59. As in the case of the previously described designs, a locking element 74 is securely fixed in the wall 58 and a locking element 75 in the wall 59.

Figure 9:
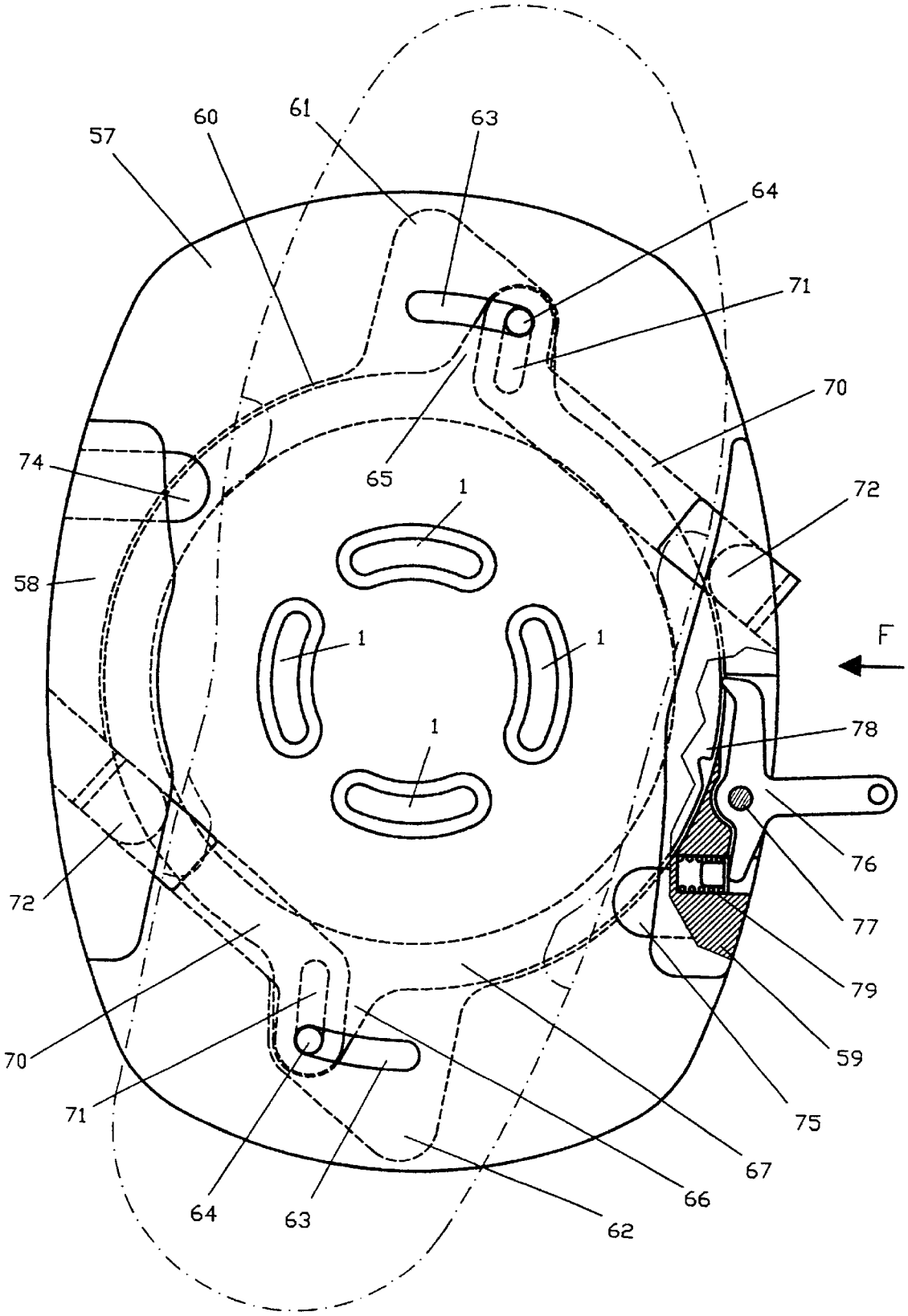
Figure 10:
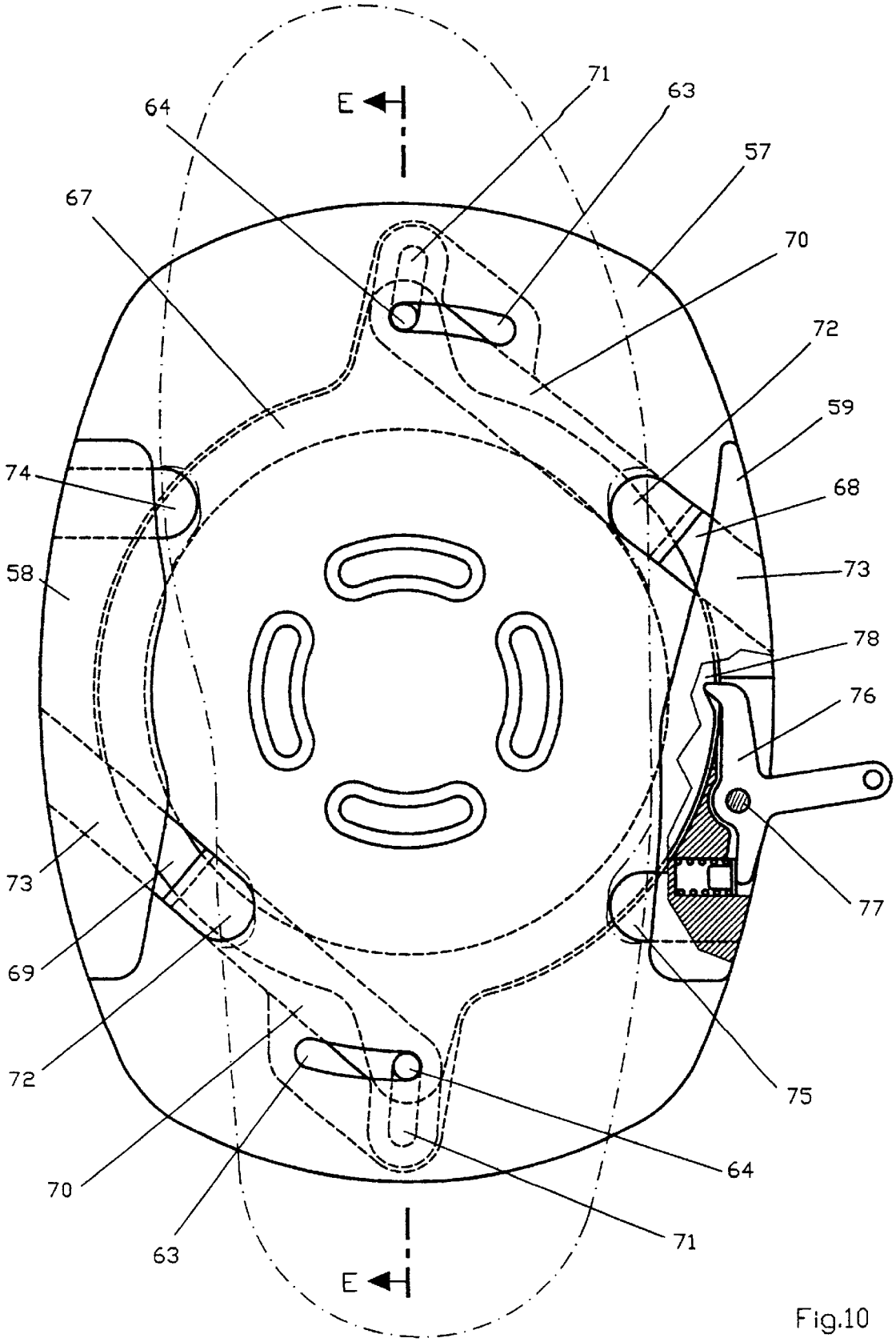
FIG. 10: a plan view corresponding to FIG. 9, but in the closed condition of the connecting device.

In FIGS. 9 and 10 the wall 59 is partially cut open to better show a locking element which is designed as a locking pawl 76 and can be pivoted about a spindle 77. The locking pawl is situated in the plane of the disc 67. A recess on the circumference of the disc causes the formation of a locking tooth 78 which the locking pawl engages behind, in the closed position of the device (cf. FIG. 10). The locking pawl is of approximately T-shaped design. The arm in the extended portion of the pawl arm is loaded by a spring 79, whereas the web serves as an actuating handle.

FIG. 9 in turn shows the connecting device in the entry and exit position. By pivoting the shoe, the device is transferred into the position according to FIG. 10. When this position is reached, the locking pawl 76 secures the position of the disc 67 by engaging behind the locking tooth 78, and thus also the blocking of the shoe by means of the locking elements. In this case, to release the shoe it is merely necessary to pivot the locking pawl 76 counter to the force of the spring 76, with regard to the representation in the clockwise direction, until it comes out of engagement with the locking tooth 78. The shoe can then be rotated again into the position according to FIG. 9.

What is claimed is:

1. A selectively closable and releasable connecting device for connecting a sports shoe, defining a lateral groove at it sole, and an item of sports equipment, said connecting device comprising:

a baseplate for fixedly mounting on said item of sports equipment and defining a support surface on which the shoe can be supported and locked, wherein said base plate is provided with a pair of rigid locking elements lying diametrically opposite each other, with respect to a central pivot for the shoe, characterized in that said connecting device has at least one additional pair of moveable locking elements for each side of the shoe sole, wherein each element of each said additional pair is diametrically opposite one another and connected for rotation with respect to the baseplate via a gear mechanism having a driving element provided with at least one driver which protrudes with respect to the support surface of the baseplate, for actuation, by the shoe, wherein said driver is guided in an elongated hole, defined by the baseplate, which is curved about the central pivot, and a locking element is provided for blocking the gear mechanism in a closed position.

2. The connecting device according to claim 1, wherein the baseplate is designed as a housing for the gear mechanism.

3. The connecting device according to claim 1 or 2, wherein the gear mechanism has a toothed ring which can be pivoted about the central pivot and bears the two movable locking elements.

4. The connecting device according to claim 3, wherein the driver is made of a spindle of a toothed wheel whose teeth mesh, on the one hand, with those of the toothed ring and, on the other hand, with an internal toothing fixed on the baseplate.

5. The connecting device according to claim 4, wherein the spindle of the toothed wheel tapers at its free end.

6. The connecting device according to claim 4, wherein the spindle of the toothed wheel bears a U-shaped step-on hoop, the spacing of the limbs of which corresponds to the width of the sole.

7. The connecting device according to claim 1, wherein the gear mechanism has a disc which can be rotated about the central pivot and on which the driver is provided.

8. The connecting device according to claim 7, wherein the driver is in operative connection with one arm of a two-armed lever which is mounted pivotably about a vertical spindle in the baseplate, wherein a ram is coupled to each free end of the two lever arms, the baseplate defines slideways for the rams, and wherein each free end of the rams form or bear each of said at least one pair of movable locking elements.

9. The connecting device according to claim 7, wherein said at least one pair of movable locking elements are designed as rotary locks is rotatably mounted in the baseplate and biased in an opening direction by a spring, wherein the outside of the rotary locks bear a control curve which is acted upon by a roller rotatably mounted and arranged parallel to the driver on the rotatable disc.

10. The connecting device according to claim 9, wherein each rotary lock is provided with an opening lug in place of the spring, or additionally thereto, and wherein the control curve extends to the end of the opening lug.

11. The connecting device according to claim 1 wherein said at least one driver comprises two drivers lie in a vertical longitudinal central plane, in the closed position of the device.

12. The connecting device according to claim 7, wherein each driver is in operative connection with a slide, in that each slide is identical and mounted in slideways of the baseplate, and wherein the free ends of the slides form or bear the at least one pair of movable locking elements.

13. The connecting device according to claim 7, wherein said locking element for the gear mechanism is a vertically displaceable locking pin, in the baseplate, loaded by a spring and can be latched, by its inner end, into a latching recess in a toothed ring or disc of the gear mechanism, and wherein at its outer end, the locking pin is designed as an actuating handle or adapted for the connection of such a handle.

14. The connecting device according to claim 7, wherein the locking element for the gear mechanism is made of a spring-loaded locking pawl on the baseplate, wherein a locking tooth is provided on a toothed ring or disc, and wherein the locking pawl has an actuating handle or is adapted for the connection for such a handle.

15. The connecting device according to claim 7, wherein the locking element for the gear mechanism is a double lever between the baseplate and a toothed ring or disc.

16. A selectively closable and releasable connecting device for connecting a sports shoe, defining a lateral groove at it sole, and an item of sports equipment, said connecting device comprising:

a baseplate for fixedly mounting on said item of sports equipment and defining a support surface on which the shoe can be supported and locked, wherein said base plate is provided with a pair of rigid locking elements lying diametrically opposite each other, with respect to a central pivot for the shoe, has at least one additional pair of moveable locking elements for each side of the shoe sole, wherein each element of each said additional pair is diametrically opposite one another and connected for rotation with respect to the baseplate via a gear mechanism having a driving element provided with at least one driver which protrudes with respect to the supporting surface of the baseplate for actuation by the shoe, wherein said driver is guided in an elongated hole, defined by the baseplate, which is curved about the central pivot, and a locking element for blocking the gear mechanism in a closed position wherein said at least one pair of movable locking elements are designed as rotary locks rotatably mounted in the baseplate and are biased in an opening direction by a spring, wherein the outside of the rotary locks bear a control curve which is acted upon by a roller rotatably mounted and arranged parallel to the driver on a rotatable disc.

17. The connecting device according to claim 16, wherein each rotary lock is provided with an opening lug in place of the spring, or additionally thereto, and wherein the control curve extends to the end of the opening lug.

18. A selectively closable and releasable connecting device for connecting a sports shoe, defining a lateral groove at it sole, and an item of sports equipment, said connecting device comprising:

a baseplate for fixedly mounting on said item of sports equipment and defining a support surface on which the shoe can be supported and locked, wherein said base plate is provided with a pair of rigid locking elements lying diametrically opposite each other, with respect to a central pivot for the shoe, has at least one additional pair of moveable locking elements for each side of the shoe sole, wherein each element of each said additional pair is diametrically opposite one another and connected for rotation with respect to the baseplate via a gear mechanism having a driving element provided with at least one driver which protrudes with respect to the supporting surface of the baseplate, for actuation, by the shoe, wherein said driver is guided about the central pivot, in the baseplate, and a locking element for blocking the gear mechanism in a closed position.

* * * * *